US005981878A

United States Patent [19]

Zhao et al.

[11] Patent Number: 5,981,878

[45] Date of Patent: Nov. 9, 1999

[54] POLYMER INSULATORS WITH METAL CAPS

[75] Inventors: Tiebin Zhao; Viorel Berlovan, Jr., both of Medina; John A. Krause, Eastlake, all of Ohio

[73] Assignee: Hubbell Incorporated, Orange, Conn.

[21] Appl. No.: 08/995,365

[22] Filed: Dec. 22, 1997

Related U.S. Application Data

[63] Continuation-in-part of application No. 08/635,764, Apr. 22, 1996, abandoned.

[51] Int. Cl.[6] ..... H01B 17/14

[52] U.S. Cl. ..... 174/158 R; 174/168; 174/212; 174/178

[58] Field of Search ..... 174/158 R, 168, 174/174, 179, 189, 194, 195, 196, 199, 201, 212, 137 A, 182, 176, 177, 178; D8/364

[56] References Cited

U.S. PATENT DOCUMENTS

| | | | |
|---|---|---|---|
| 1,841,949 | 1/1932 | Hawley | 174/169 |
| 2,266,400 | 12/1941 | Reed | 174/174 |
| 3,194,879 | 7/1965 | Hopwood | 174/140 C |
| 4,658,092 | 4/1987 | Nakamura et al. | 174/182 |
| 4,782,199 | 11/1988 | Seike et al. | 174/189 |
| 4,940,857 | 7/1990 | Giroux | 174/174 |
| 5,147,984 | 9/1992 | Mazeika et al. | 174/141 |

FOREIGN PATENT DOCUMENTS

| | | | |
|---|---|---|---|
| 2190799 | 11/1987 | United Kingdom | 174/182 |

*Primary Examiner*—Dean A. Reichard
*Assistant Examiner*—Dhiru R Patel
*Attorney, Agent, or Firm*—Jerry M. Presson; Mark S. Bicks

[57] ABSTRACT

An electrical insulator for supporting an electrical conductor includes a load sustaining molded core, a mounting on the core, an dielectric sheath, and a metal cap. The molded core is formed of a dielectric polymer with opposite longitudinal ends and a profiled lateral outer surface between the ends. The dielectric outer sheath overlies the core outer surface and has a weathershed extending laterally outwardly relative to the core. A metal cap is secured to one end of the core by the metal cap having a portion directly molded to the core. The mounting is located on the end of the core opposite the metal cap.

20 Claims, 2 Drawing Sheets

POLYMER INSULATORS WITH METAL CAPS

REFERENCE TO THE RELATED APPLICATION

This application is a continuation-in-part of U.S. patent application Ser. No. 08/635,764, entitled ELECTRICAL INSULATORS WITH MECHANICAL CORE AND DIELECTRIC SHEATH and filed on Apr. 22, 1996, now abandoned in the names of John D. Sakich, Viorel Berlovan, Jr., John A. Krause and Randall K. Niedermier, the subject matter of which is hereby incorporated by reference.

FIELD OF THE INVENTION

The present invention relates to electrical insulators having a molded core of dielectric polymer, a lateral dielectric sheath with at least one weathershed, and a metal cap molded to one end of the polymer core.

BACKGROUND OF THE INVENTION

Overhead electric power lines, wires or cables are supported by poles or towers which may be constructed of wood, metal or other construction materials. The overhead power liens are mounted on the poles or towers by insulators which are maintained upright by an upstanding pin engaged in an axial blind bore of the insulator body.

These insulators were, in the past, typically constructed of a ceramic material such as porcelain, and have a variety of shapes and/or designs depending upon the necessary mechanical strength, dielectric strength and leakage distance. However, the use of porcelain for insulators has several disadvantages. For example, porcelain insulators are often very heavy to provide the necessary mechanical and electrical characteristics. Moreover, such porcelain insulators are typically expensive to install and require strong supporting structures. Additionally, porcelain insulators are brittle, and thus, subject to being damaged during shipping and installation. Porcelain insulators are also susceptible to vandalism damage.

Accordingly, in recent years, newer insulators have been developed which include a fiberglass reinforced polymer core and an external protective housing forming annular flanges and webbed weathersheds. The weathershed housing or sheath is usually made of an elastomeric or an epoxy material. Elastomer or epoxy sheaths are designed to protect the fiberglass reinforced cores from weather and electrical activity. Weather and electrical activity degrade the mechanical strength of the fiberglass reinforced cores. The weathersheds on the housing intercept water flow down the insulators and increase the distance along the surface of the insulator for better electrical performance in wet or contaminated conditions.

With use of a dielectric polymer core, significant stresses, particularly electrical stresses, are created between the line wire and the ground insert coupled to the insulator. Additionally, the use of externally mounted clamps hinders installation and increases the cost of the components.

SUMMARY OF THE INVENTION

An object of the present invention is to provide an electrical insulator having a molded core of a dielectric polymer and having a metal cap secured at one core end to smooth stresses, particularly electrical stresses, between the line wire and the ground insert coupled to the insulator.

Another object of the present invention is to provide an electrical insulator with a metal clamp molded into the polymer core to reduce installation time and to decrease the cost of the clamping components.

A further object of the present invention is to provide an electrical insulator having a molded core of a dielectric polymer which is simple and inexpensive to manufacture, is of rugged construction, and can be adapted to a wide variety of uses.

The foregoing objects are basically obtained by an electrical insulator for supporting an electrical conductor comprising a load sustaining molded core of a dielectric polymer, a mounting for a support member, an outer dielectric sheath, and a metal cap. The core has first and second opposite longitudinal ends and a profiled lateral outer surface between the ends. The mounting is located on the second end of the core. The dielectric sheath overlies the outer surface of the core, and has at least one weathershed extending laterally outwardly relative to the core. The metal cap is secured to the core at its first end by the metal cap having a portion molded directly to the core.

By forming the electrical insulator in this manner, the electrical insulator can be easily and inexpensively manufactured with the metal cap securely affixed on it by the molding of the core in the presence of the metal cap. The metal cap provides a shielding effect which can essentially eliminate the electrical stress concentration at the energized line. With the metal cap secured on the core, the electrical insulator also smoothes the electrical stresses in the dielectric materials between the line wire and the ground insert attached to the electrical insulator, which ground insert is provided by the support member on which the core is mounted, to reduce the requirements for the dielectric strength of the materials.

Additionally, the dielectric polymer material used to form the core, along with the separate sheath, avoids the disadvantages of conventional electrical insulators made of porcelain.

Other objects, advantages and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure.

DETAILED DESCRIPTION OF THE INVENTION

Figure 1:
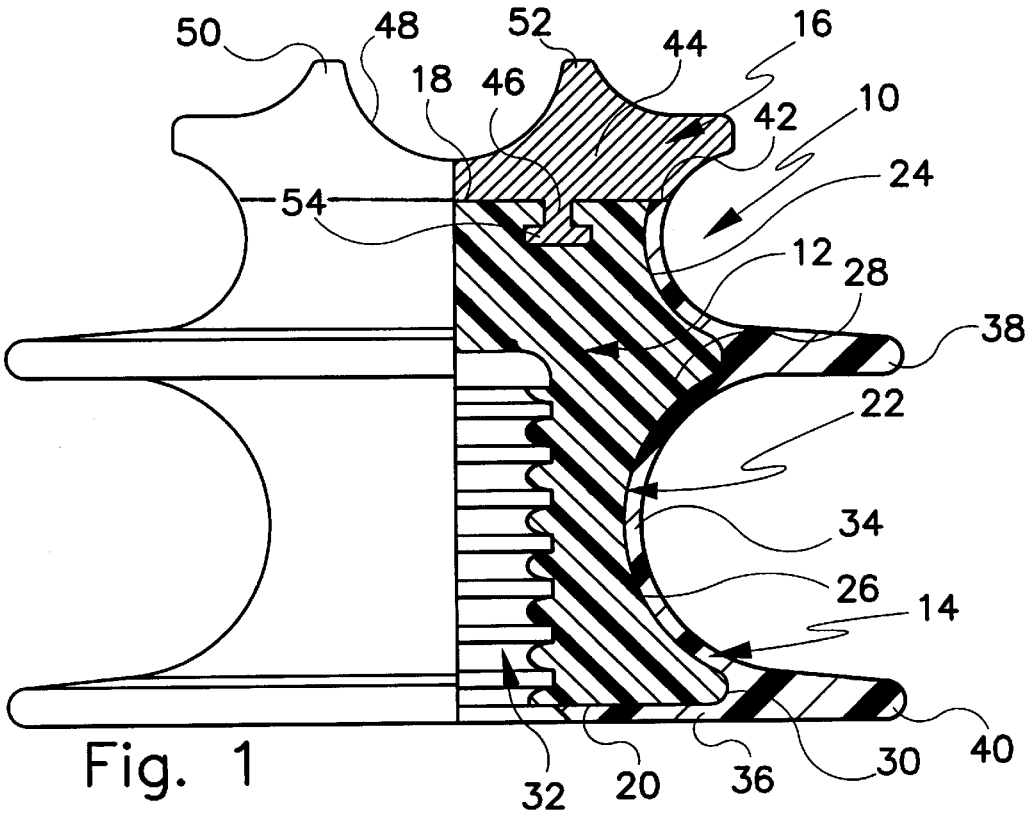
FIG. 1 is a side elevational view in partial section of an electrical insulator according to a first embodiment of the present invention.
Figure 2:
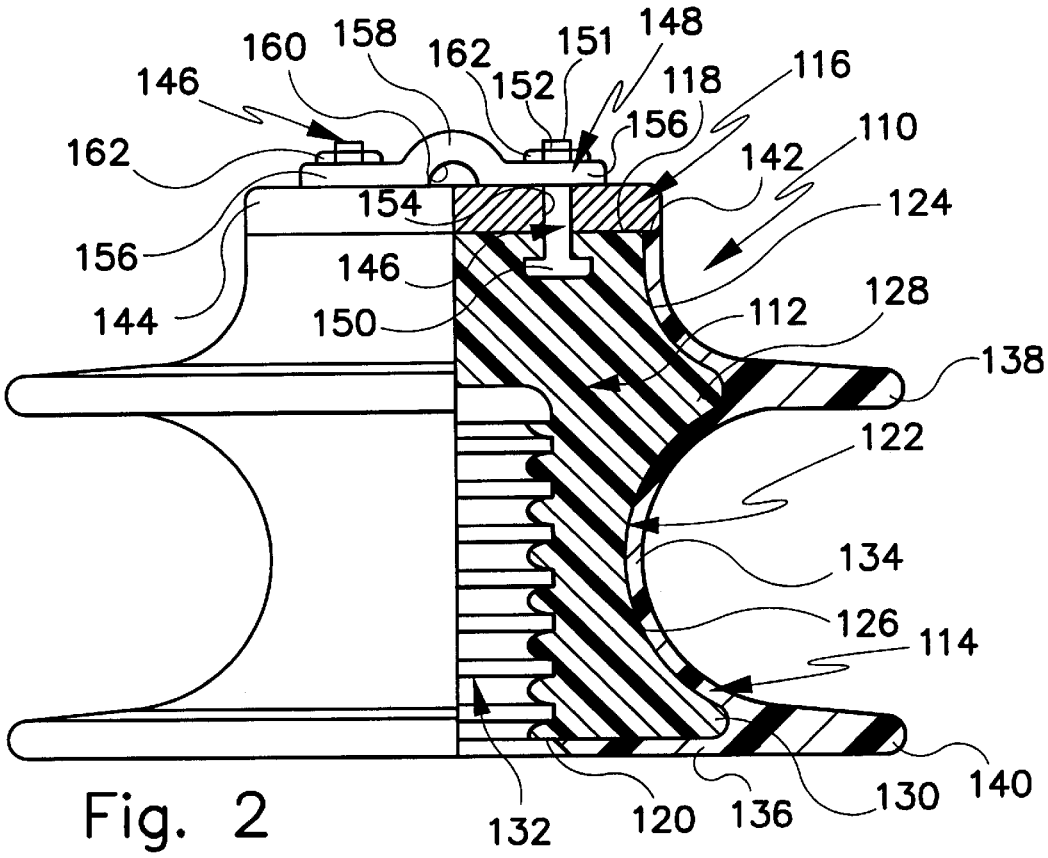
FIG. 2 is a side elevational view in partial section of an electrical insulator according to a second embodiment of the present invention.
Figure 3:
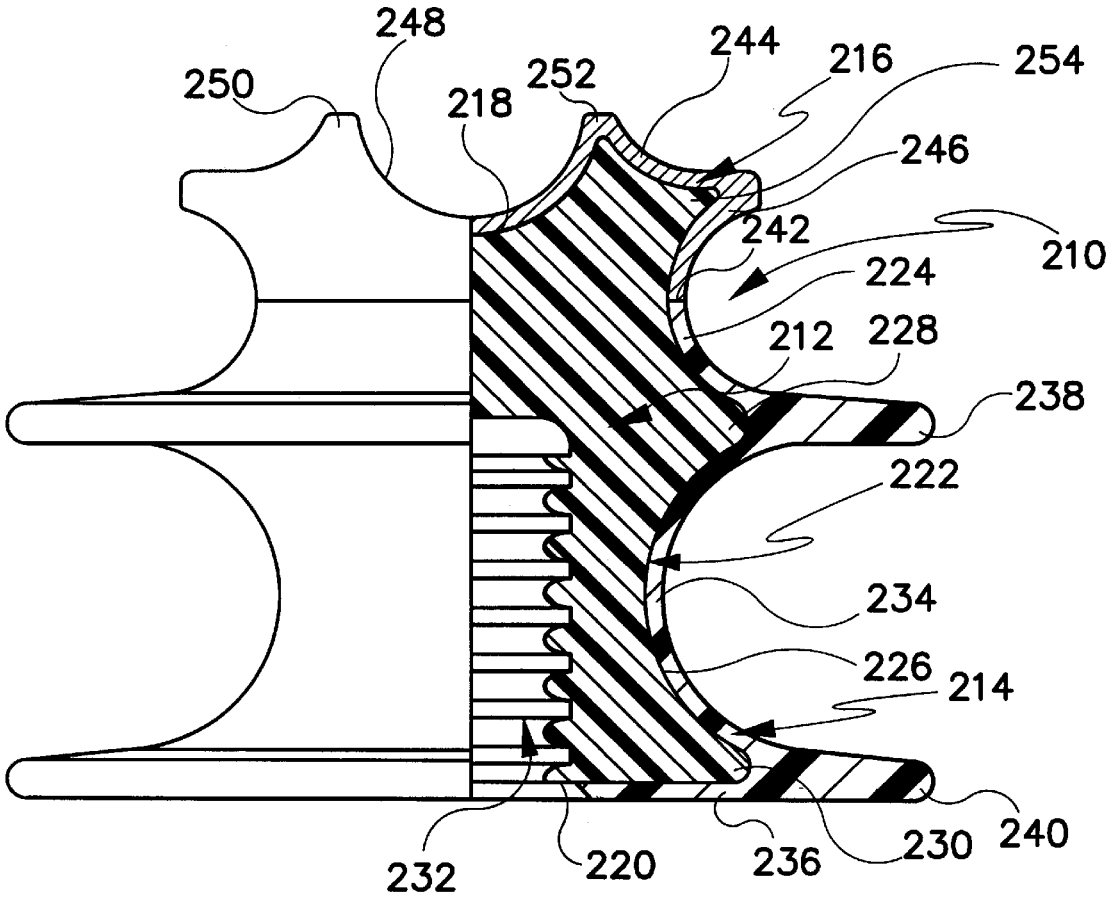
FIG. 3 is a side elevational view in partial section of an electrical insulator according to a third embodiment of the present invention.

FIGS. 1–3 illustrate pin-type insulators for insulating electric power lines in a network to supply power to consumers. Insulator 10, as illustrated in FIG. 1 and according to the first embodiment, comprises a load sustaining molded core 12, an outer dielectric sheath 14 and a top metal cap 16.

Core 12 is formed of any suitable dielectric polymer, such as epoxy or polyester, meeting the necessary mechanical strength characteristics for the intended use of the insulator.

Other suitable materials can include various types of clays, reinforced or unreinforced epoxies, polyesters, vinyl esters and other plastics.

Core 12, as illustrated in FIG. 1, extends along a longitudinal axis between a first end 18 and an opposite second end 20. Between the two ends, the core includes a profiled lateral outer surface 21. Outer surface 21 includes upper and lower recesses 24 and 26, and two laterally or radially outwardly extending flanges 28 and 30. Upper flange 28 extends between recesses 24 and 26. Lower flange 30 defines the lower end of recess 26 and is located at core second end 20.

An internally threaded blind bore 32 is formed in core 12. The blind bore opens on second end 20 and extends into core 12, terminating at its closed end located at a distance from core first end 18. Bore 32 enables the insulator to be attached to an upstanding pin extending from a cross arm of a utility pole or tower.

Dielectric sheath 14 covers core lateral outer surface 22 and substantially all of the core surface on second end 20. The sheath protects the core from the weather elements, ultra-violet rays and electrical surface discharges. The dielectric material of the sheath is preferably an elastomer or a plastic polymer, such as a thermoplastic material or a thermosetting material satisfying the necessary characteristics for protecting the core. Placement of the dielectric sheath over the core can be accomplished by conventional molding methods, such as compression, injection or transfer. Alternatively, the sheath can be applied to the core by dipping, painting or spraying sheath material on to the core.

Sheath 14 comprises a lateral portion 34 that covers the core lateral surface and an end portion 36 covering the core second end surface about bore 32. The sheath lateral portion is provided with two weathersheds 38 and 40 which are spaced along the longitudinal axis of the sheath and are aligned with bore flanges 28 and 30, respectively. The sheath end 42 is essentially coplanar with core end 18.

Metal cap 16 comprises plate portion 44 and a plurality of depending anchor members 46. Plate portion 44 has a profiled upper surface defining a groove 48 between two projections 50 and 52. The projections and groove receive and retain an electrical line or cable extending substantially perpendicular to the longitudinal axis of insulator 10. The lateral periphery of plate portion 44 extends laterally beyond the periphery of core end 18 to abut sheath end 42.

Although only one depending anchor member 46 is illustrated in FIG. 1, any desired number of depending members can be provided, depending on the mechanical requirements of the attachment of the metal cap to core 12. An enlarged distal end 54 is provided on the end of each depending member 46 remote or spaced from plate 44.

Metal cap 16, with its depending anchoring member or members 46, is separately formed by casting, machining or other conventional process, such that the plate 44 and the anchoring members 46 forming metal cap 16 are unitarily formed as a single piece. The completely formed metal cap is then placed in a suitable mold for forming core 12. As the polymer material is placed in the mold, it surrounds anchoring members 46. When the material hardens or cures, anchoring members 46 are retained within the core to securely affix the metal cap to the core. After formation of the core and securing of the metal cap thereto, the sheath 14 can be applied as described above.

FIG. 2 illustrates a second embodiment of the present invention providing a pin-type electrical insulator 110. Insulator 110 comprises a load sustaining molded core 112, an outer dielectric sheath 114 and a top metal cap 116.

Core 112 is formed of any suitable dielectric polymer, such as epoxy or polyester, meeting the necessary mechanical strength characteristics for the intended use of the insulator. Other suitable materials can include various types of clays, reinforced or unreinforced epoxies, polyesters, vinyl esters and other plastics.

Core 112, as illustrated in FIG. 2, extends along a longitudinal axis between a first end 118 and an opposite second end 120. Between the two ends, the core includes a profiled lateral outer surface 121. Outer surface 121 includes upper and lower recesses 124 and 126, and two laterally or radially outwardly extending flanges 128 and 130. Upper flange 128 extends between recesses 124 and 126. Lower flange 130 defines the lower end of recess 126 and is located at core second end 120.

An internally threaded blind bore 132 is formed in core 112. The blind bore opens on second end 120 and extends into core 112, terminating at its closed end located at a distance from core first end 118. Bore 132 enables the insulator to be attached to an upstanding pin extending from a cross arm of a utility pole or tower.

Dielectric sheath 114 covers core lateral outer surface 122 and substantially all of the core surface on second end 120. The sheath protects the core from the weather elements, ultra-violet rays and electrical surface discharges. The dielectric material of the sheath is preferably an elastomer or a plastic polymer, such as a thermoplastic material or a thermosetting material satisfying the necessary characteristics for protecting the core. Placement of the dielectric sheath over the core can be accomplished by conventional molding methods, such as compression, injection or transfer. Alternatively, the sheath can be applied to the core by dipping, painting or spraying sheath material on to the core.

Sheath 114 comprises a lateral portion 134 that covers the core lateral surface and an end portion 136 covering the core second end surface about bore 132. The sheath lateral portion is provided with two weathersheds 138 and 140 which are spaced along the longitudinal axis of the sheath and are aligned with bore flanges 128 and 130, respectively. The sheath end 142 is essentially coplanar with core end 118.

Metal cap 116 comprises a planar plate 144, a plurality of depending fasteners 146 and a clamp 148. Fasteners 146 depend from or extend below plate 144 and into core 112. Each fastener has an enlarged distal end 150 embedded within the core and spaced from core first end 118. The shank of each fastener extends in a longitudinal direction beyond core first end 118. The exposed or outer end 151 of each fastener is provided with an external thread 152.

Plate 144 is generally planar and comprises a plurality of axially extending openings 154 of a number and spacing to mate with fasteners 146. The portions or outer ends 151 portions of the fasteners extending beyond core first end 118 extend through the openings in the plate.

Clamp 148 is generally in the form of an elongated strap with end parts 156 and a center part 158 with a recess 160. Fasteners 146 extend through openings in the clamp end parts 156. Clamp 148 and plate 144 are locked in place by internally threaded nuts 162. Nuts 162 are threaded engaged with fastener threads 152.

Similar to the first embodiment, fasteners 146 are located in a suitable mold for forming core 112. When the dielectric material forming the core is placed in the mold, the material surrounds the portion of the fasteners adjacent enlarged ends 150 to embed the fasteners in the core, as illustrated in FIG. 2. Once the core has solidified or cured, plate 144 is mounted on core end 118, with the fasteners passing through openings 154 in the plate. Clamp 148 is then mounted over the plate 144, with the plate and clamp being secured in place by nuts 162.

After the insulator is mounted on a support, a line or cable can be positively attached to the insulator by means of clamp 148. To attach the line or cable to the insulator, one or both of the nuts are loosened or removed to locate the line or cable within recess 160, and between clamp 148 and plate 144. Replacing and/or tightening nuts 162 on fasteners 146 will frictionally engage the line or cable, as well as secure plate 144 and clamp 148 in position.

FIG. 3 illustrates a third embodiment of the present invention providing an electrical insulator 210. Insulator 210 comprises a load sustaining molded core 212, an outer dielectric sheath 214 and a top metal cap 216.

Core 212 is formed of any suitable dielectric polymer, such as epoxy or polyester, meeting the necessary mechanical strength characteristics for the intended use of the insulator. Other suitable materials can include various types of clays, reinforced or unreinforced epoxies, polyesters, vinyl esters and other plastics.

Core 212, as illustrated in FIG. 3, extends along a longitudinal axis between a first end 218 and an opposite second end 220. Between the two ends, the core includes a profiled lateral outer surface 221. Outer surface 221 includes upper and lower recesses 224 and 226, and two laterally or radially outwardly extending flanges 228 and 230. Upper flange 228 extends between recesses 224 and 226. Lower flange 230 defines the lower end of recess 226 and is located at core second end 220.

An internally threaded blind bore 232 is formed in core 212. The blind bore opens on second end 220 and extends into core 212, terminating at its closed end located at a distance from core first end 218. Bore 232 enables the insulator to be attached to an upstanding pin extending from a cross arm of a utility pole or tower.

Dielectric sheath 214 covers core lateral outer surface 222 and substantially all of the core surface on second end 220. The sheath protects the core from the weather elements, ultra-violet rays and electrical surface discharges. The dielectric material of the sheath is preferably an elastomer or a plastic polymer, such as a thermoplastic material or a thermosetting material satisfying the necessary characteristics for protecting the core. Placement of the dielectric sheath over the core can be accomplished by conventional molding methods, such as compression, injection or transfer. Alternatively, the sheath can be applied to the core by dipping, painting or spraying sheath material on to the core.

Sheath 214 comprises a lateral portion 234 that covers the core lateral surface and an end portion 236 covering the core second end surface about bore 232. The sheath lateral portion is provided with two weathersheds 238 and 240 which are spaced along the longitudinal axis of the sheath and are aligned with bore flanges 228 and 230, respectively. The sheath end 242 is essentially coplanar with core end 218.

Metal cap 216 comprises a plate portion 244 which extends over core first end 218 and a lateral portion 246 extending from the periphery of end plate portion 244. Plate portion 244 comprises a groove 248 bounded on each side by longitudinally extending projections 250 and 252. The groove 248 and the projections 250 are of a configuration similar to the groove 48 and the projections 50 and 52 of the first embodiment, and function in a similar manner. Lateral portion 246 depends from or extends downwardly from plate portion 244, and tapers in a direction away from the plate portion. In other words, the cross-sectional dimensions of the lateral portion decrease in a direction away from plate portion 244.

Metal cap 216 is placed in a mold for forming core 212. The polymer material for forming the core fills the cavity formed by plate portion 244 and lateral portion 246. In forming the core in this manner, an additional flange 254 is provided on the core and extends radially outwardly from the core adjacent first end 218. In this manner, upper recess 224 is bounded on its opposite longitudinal ends by flange 254 and by flange 228. The lateral portion 246 will then extend over flange 254 and over at least a portion of an undercut portion provided by recess 224.

While various embodiments have been chosen to illustrate the invention, it will be understood by those skilled in the art that various changes and modifications can be made therein without departing from the scope of the invention as defined in the appended claims.

What is claimed is:

1. An electrical insulator for supporting an electrical conductor, comprising:

a load sustaining molded core of a dielectric polymer having first and second opposite longitudinal ends and a profiled lateral outer surface between said ends;

a mounting on said core at said second end to couple said core to a support member;

an outer dielectric sheath overlying said outer surface of said core and having at least one weathershed extending laterally outwardly relative to said core; and a metal cap secured to said core at said first end thereof by said metal cap having a portion thereof molded directly to said core.

2. An electrical insulator according to claim 1 wherein said metal cap portion comprises a depending member having an enlarged distal end embedded in said core.

3. An electrical insulator according to claim 2 wherein said depending member is unitarily formed as a single piece with said metal cap.

4. An electrical insulator according to claim 3 wherein said metal cap is a unitary member and comprises an upwardly opening groove in a surface thereof remote from said core.

5. An electrical insulator according to claim 2 wherein said depending member comprises an outer end extending through an opening in said metal cap.

6. An electrical insulator according to claim 5 wherein a clamp is releasably attached to said outer end of said depending member for gripping a cable with said metal cap.

7. An electrical insulator according to claim 6 wherein said outer end comprises a thread; and said clamp comprises a threaded member threadedly engaging said thread and a clamp member between said threaded member and said metal cap and received on said outer end.

8. An electrical insulator according to claim 1 wherein said metal cap comprises an end portion covering said first end of said core and a lateral portion covering an adjacent section of said outer surface.

9. An electrical insulator according to claim 8 wherein said end portion of said metal cap comprises a cable receiving groove extending substantially transverse to a longitudinal axis of said core.

10. An electrical insulator according to claim 9 wherein said outer surface of said core comprises a laterally extending flange adjacent said first end and an undercut portion adjacent said flange and spaced from said first end; and said lateral portion of said metal cap extends over said flange and over at least a portion of said undercut portion.

11. An electrical insulator according to claim 9 wherein said core is molded in said metal cap.

12. An electrical insulator according to claim 1 wherein said mounting comprises a bore in said core opening on said second end.

13. An electrical insulator according to claim 12 wherein said bore is internally threaded.

14. An electrical insulator according to claim 1 wherein said sheath overlies a portion of said second end of said core.

15. An electrical insulator according to claim 1 wherein a longitudinal end of said sheath abuts said metal cap such that said sheath does not extend between said metal cap and said core.

16. An electrical insulator for supporting an electrical conductor, comprising:

a load sustaining molded core of a dielectric polymer having first and second opposite longitudinal ends and a profiled lateral outer surface between said ends;

an internally threaded bore in said core and opening on said second end;

an outer dielectric sheath overlying said outer surface of said core and having at least one weathershed extending laterally outwardly relative to said core; and a metal cap mounted on said core at said first end thereof, said metal cap having at least one depending member with an enlarged distal end molded in said core.

17. An electrical insulator according to claim 16 wherein said at least one depending member is unitarily formed as a single piece with said metal cap; and said metal cap is a unitary member and comprises an upwardly opening groove in a surface thereof remote from said core.

18. An electrical insulator according to claim 17 wherein said at least one depending member comprises an externally threaded outer end extending through an opening in said metal cap;

an internally threaded member threadedly engages said outer end; and a clamp member is mounted on said outer end between said threaded member and said metal cap.

19. An electrical insulator for supporting an electrical conductor, comprising:

a load sustaining molded core of a dielectric polymer having first and second opposite longitudinal ends and a profiled lateral outer surface between said ends;

an internally threaded bore in said core and opening on said second end;

an outer dielectric sheath overlying said outer surface of said core and having at least one weathershed extending laterally outwardly relative to said core; and a metal cap, said core being molded at said first end thereof in said metal cap, said metal cap having an end portion and a tapered lateral portion extending from a periphery of said end portion.

20. An electrical insulator according to claim 19 wherein said outer surface of said core comprises a laterally extending flange adjacent said first end and an undercut portion adjacent said flange and spaced from said first end; and said lateral portion of said metal cap extends over said flange and over at least a portion of said undercut portion.

* * * * *